US006583560B1

(12) United States Patent
Amemiya

(10) Patent No.: US 6,583,560 B1
(45) Date of Patent: Jun. 24, 2003

(54) PLASMA DISPLAY PANEL

(75) Inventor: Kimio Amemiya, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 325 days.

(21) Appl. No.: 09/708,052

(22) Filed: Nov. 8, 2000

(30) Foreign Application Priority Data

Nov. 26, 1999 (JP) ..... 11-336429

(51) Int. Cl.[7] ..... H01J 17/49
(52) U.S. Cl. ..... 313/586; 313/582; 313/583
(58) Field of Search ..... 313/582–587

(56) References Cited

U.S. PATENT DOCUMENTS 5,182,489 A * 1/1993 Sano ..... 313/485
5,659,226 A * 8/1997 Shigeta ..... 313/491
5,661,500 A * 8/1997 Shinoda et al. ..... 345/60
5,736,815 A * 4/1998 Amemiya ..... 313/586
5,742,122 A * 4/1998 Amemiya et al. ..... 313/582
5,825,128 A * 10/1998 Betsui et al. ..... 313/582
5,962,974 A * 10/1999 Komaki et al. ..... 313/582
6,236,160 B1 * 5/2001 Komaki et al. ..... 313/586
6,288,488 B1 * 9/2001 Amemiya ..... 313/582
6,333,597 B1 * 12/2001 Mitomo ..... 313/489
6,376,986 B1 * 4/2002 Takagi et al. ..... 313/582
6,411,033 B1 * 6/2002 Mori et al. ..... 313/582
6,479,932 B1 * 11/2002 Nunomura ..... 313/582

* cited by examiner

*Primary Examiner*—Robert H. Kim
*Assistant Examiner*—Jurie Yun
(74) *Attorney, Agent, or Firm*—Arent Fox Kintner Plotkin & Kahn

(57) ABSTRACT

Row electrodes X, Y have bus electrodes Xb, Yb extending in the row direction and a plurality of transparent electrodes Xa, Xa', Ya, Ya' extending in the column direction, arranged along the bus electrodes Xb, Yb and connected to the bus electrodes Xb, Yb with intersecting. Each end of the transparent electrodes Xa, Xa', Ya, Ya' of one of the row electrodes X, Y and each end of the corresponding transparent electrodes Xa, Xa', Ya, Ya' of the other are opposed to each other with a discharge gap g in between. Discharge cells C, C' are formed in a discharge space between a front glass substrate 10 and a back glass substrate 13, opposing the transparent electrodes Xa, Xa', Ya, Ya', which form pairs by opposing each other.

9 Claims, 7 Drawing Sheets

V−V

W−W

PLASMA DISPLAY PANEL

BACKGROUND OF THE INVENTION

1. Field of the Invention

The invention relates to a cell structure of a plasma display panel.

2. Description of the Related Art

Recent years, a plasma display panel (referred to "PDP" hereinafter) of a surface discharge scheme AC type as an oversized and slim display for color screen has been received attention, which is becoming widely available.

FIG. 8 is a schematically plane view of a conventional cell structure of such PDP. FIG. 9 is a sectional view taken along the V—V line of FIG. 8. FIG. 10 is a sectional view taken along the W—W line of FIG. 8.

In FIG. 8 to FIG. 10, on the backside of a front glass substrate 1 to serve as a display screen of the PDP, there is sequentially provided with a plurality of row electrode pairs (X', Y'); a dielectric layer 2 covering the row electrode pairs (X', Y'); and a protective layer 3 made of MgO which covers a backside of the dielectric layer 2.

The row electrodes X' and Y' respectively consist of wider transparent electrodes Xa' and Ya' each of which is formed of a transparent conductive film made of ITO (Indium Tin Oxide) or the like, and narrower bus electrodes Xb' and Yb' each of which is formed of a metal film, complementary to conductivity of the transparent electrode.

The row electrodes X' and Y' are arranged opposing each other with a discharge gap g' in between, and alternate in the column direction to form a display line (row) L on a matrix display screen.

A back glass substrate 4 faces the front glass substrate 1 with a discharge space S, filled with a discharge gas, in between. The back glass substrate 4 is provided with a plurality of column electrodes D' arranged to extend in a direction perpendicular to the row electrode pairs X' and Y'; band-shaped partition walls 5 each extending between the adjacent column electrodes D' in parallel; and a red phosphor layer 6(R), green phosphor layer 6(G) and blue phosphor layer 6(B) which respectively overlay side faces of the partition walls 5 and the column electrodes D'.

In each display line L, discharge cells C are divided by the partition walls 5 in the column direction, and respectively formed at intersections of the column electrodes D' and the row electrode pair (X', Y') in the discharge space S'.

In the above PDP, an image is displayed as follows:

First, through address operation, discharge (opposite discharge) is generated selectively between the row electrode pairs (X', Y') and the column electrodes D' in the respective discharge cells C, to scatter lighted cells (the discharge cell C formed with wall charge on the dielectric layer 2) and nonlighted cells (the discharge cell C not formed with wall charge on the dielectric layer 2), over the panel in accordance with the image to be displayed.

After the address operation, in all the display lines L, the discharge sustain pulse is applied alternately to the row electrode pairs (X', Y') in unison, and thus discharge (surface discharge) is produced in the lighted cells on every application of the discharge sustain pulse.

In this manner, the surface discharge in each lighted cell generates ultraviolet light, and thus the red phosphor layer 6(R) and/or the green phosphor layer 6(G) and/or the blue phosphor layer 6(B) each formed in the discharge cell C are excited to emit light, resulting in forming the display screen.

For the PDP as configured above, displaying images with definition needs to reduce a size of each discharge cell C to increase the number of pixels each made up of the phosphor layers 6(R), 6(G) and 6(B) as a unit.

However, fulfilling such a demand for displaying images with high definition, if each discharge cell C is reduced in size,_it causes a reduced surface area in each of the phosphor layers 6(R), 6(G) and 6(B) of the discharge cells C. This produces another problem of reduction in luminance.

In the PDP, the maximum length of extension of each of the transparent electrodes Xa' and Ya' of the respective row electrodes X' and Y' onto the discharge cell C, corresponds to approximately half the length of a longitudinal side of the discharge cell C. Therefore, when each size of the discharge cell C is reduced in order to achieve the high definition image as described above, the transparent electrodes Xa' and Ya' of the row electrodes X' and Y' are also reduced in length. This produces problems of reduction in efficiency of light emission and further reduction in luminance.

As described above, if each size of the discharge cells C is reduced to increase the number of pixels for the high definition image, this increases the number of partition walls 5 defining the discharge cells C and the row electrode pairs (X', Y'), and in turn increases an area of portions reflecting ambient light incident from the panel surface of the PDP. As a result, a problem in that the reflected light promotes reduction in contrast of an image is produced.

SUMMARY OF THE INVENTION

The present invention has been made to solve the above problems associated with the conventional plasma display panel.

It is therefore a first object of the present invention to provide a plasma display panel which is capable of preventing reduction in luminance associated with increase in definition of images.

It is a second object of the present invention to provide a plasma display panel which is capable of preventing reduction in contrast of an image due to reflection of ambient light incident from the panel surface.

To attain the first object, a plasma display panel according to a first invention includes a plurality of row electrodes extending in the row direction on a backside of a front substrate and arranged in the column direction, and a plurality of column electrodes extending in the column direction on a surface of a back substrate facing the front substrate with a discharge space in between and arranged in the row direction. Such plasma display panel is characterized in that the row electrode has an electrode main body portions extending the row direction and a plurality of protrusion electrode portions extending in the column direction and arranged along the electrode main body portions to intersect and connect with the electrode main body portions. And also, an end of the protrusion electrode portion of the row electrode opposes to an end of the protrusion electrode portion of the row electrode adjacent thereto, with a required gap in between. And then, a unit light emitting area is formed in each discharge space between the back substrate and a section of the protrusion electrode portions which are paired by the two opposing ends of the protrusion electrode portions with the required gap in between.

In the plasma display panel according to the first invention, the row electrodes constituting the unit light emitting area together with the column electrode at an intersecting section of the row electrodes and column electrode, are respectively provided with a plurality of protrusion electrode portions each intersected with and connected to the electrode main body portion extending in the row direction, for each unit light emitting area. Each of the unit light emitting area is formed at a portion where the paired protrusion electrode portions of the adjacent two row electrodes are opposed, in the discharge space.

According to the first invention, hence, the protrusion electrode portion is intersected with and connected to the electrode main body, to extend from the electrode main body in the opposite direction of the mate of the paired protrusion electrode portions. For this reason, each unit light emitting area is formed not only between the two electrode main bodies connected to the pair of protrusion electrode portions but also on each opposite side of the pair of electrode main bodies. Therefore, increase in width of each unit light emitting area in the column direction increases an area of emission.

Thus, upon the surface discharge between a pair of protrusion electrode portions, the amount of light emission in each unit light emitting area is increased to prevent the reduction of luminance associated with high definition of a screen.

In addition, efficiency of light emission is increased as a length of the protrusion electrode portion is increased in the column direction, which prevents reduction in luminance associated with high definition of a screen.

To attain the first object, the plasma display panel according to a second invention is characterized, in addition to the configuration of the first invention, in that the protrusion electrode portions of the row electrode are alternately paired with protrusion electrodes of two row electrodes on both sides of the row electrode to form the unit light emitting areas.

According to the plasma display panel of the second invention, the protrusion electrode portions arranged along the row electrode are alternately paired with the protrusion electrode portions of row electrodes on both sides of the row electrode. As a consequence of this, the unit light emitting areas formed at portions opposing the above pairs of protrusion electrode portions in the discharge space are situated at positions alternately shifting in the column direction along the row direction.

Then, a pixel is made up of the three unit light emitting areas of the thus arranged unit light emitting areas which are located at contiguous positions where a triangle is formed by connecting the centers of the three unit light emitting areas.

To attain the first object, the plasma display panel according to a third invention is characterized, in addition to the configuration of the first invention, in that the protrusion electrode portion of the row electrode extends longer from one side of the electrode main body portion than from the other side. And also, ends of the longer extensions of the respective protrusion electrode portions of the adjacent row electrodes make a pair, opposing each other with the required gap.

According to the plasma display panel of the third invention, each unit light emitting area is formed in a portion of the discharge space opposing the longer extensions of the protrusion electrodes protruding from the sides of the electrode main bodies of the two adjacent row electrodes toward the midpoint between the electrode main bodies, and a portion of the discharge space opposing the shorter extensions of the protrusion electrodes protruding from the electrode main bodies of the two adjacent row electrodes in the opposite direction from each other.

Hence, an area of emission of each unit light emitting area is increased by the shorter extension of the protrusion electrode portions extending in the discharge space in the opposite direction from the mate of the paired row electrodes, resulting in preventing reduction in luminance in the column direction.

To attain the second object, the plasma display panel according to a fourth invention is characterized, in addition to the configuration of the first invention, in that a light absorption layer not reflecting light is formed on the front face of the electrode main body portion of the row electrode.

According to the plasma display panel of the fourth invention, since the light absorption layer overlays the faces on the display surface side of the electrode main bodies which occupy the area of the image display surface of the panel except for the openings of the unit light emitting areas, ambient light incident through the front glass substrate is absorbed by the absorption layer. This prevents reflection of the incident light and reduction in contrast on the screen due to the reflection.

To attain the first object, the plasma display panel according to a fifth invention is characterized, in addition to the configuration of the first invention, in that the unit light emitting areas are defined by a partition wall made up by a vertical wall portion extending in the column direction and a transverse wall portion extending in the row direction which are disposed between the front substrate and the back substrate.

According to the plasma display panel of the fifth invention, the discharge space between the front substrate and the back substrate is defined in matrix form in the row direction and the column direction for each unit light emitting area by the transverse walls and the vertical walls of the partition wall.

This prevents a false discharge from being generated by occurrence of interference between the discharges of the unit light emitting areas adjacent to each other in the row direction and the column direction, resulting in high definition of a screen.

To attain the first object, the plasma display panel according to a sixth invention is characterized, in addition to the configuration of the fifth invention, by further including a dielectric layer formed on the backside of the front substrate to overlay the row electrodes, and in that an additional portion is formed on a portion of the dielectric layer facing the transverse wall, to protrude toward the transverse wall portion to shield the adjacent unit light emitting areas from each other in the column direction.

According to the plasma display panel of the sixth invention, the additional portion of the dielectric layer shields the adjacent unit light emitting areas from each other in the column direction. This prevents a false discharge from being generated by occurrence of interference between the discharges of the adjacent unit light emitting areas, resulting in high definition of a screen.

To attain the first object, the plasma display panel according to a seventh invention is characterized, in addition to the configuration of the first invention, in that the unit light emitting areas are defined by a band-shaped partition wall extending in the column direction between the front substrate and the back substrate.

According to the plasma display panel of the seventh invention, the band-shaped partition wall extending in the column direction defines a border between the adjacent unit light emitting areas in the row direction.

To attain the second object, the plasma display panel according to a eighth invention is characterized, in addition to the configuration of the fifth or seventh invention, in that a light absorption layer not reflecting light is formed on the face on the front substrate side of the partition wall.

According to the plasma display panel of the eighth invention, since the light absorption layer overlays the face on the display surface side of the partition wall which occupies the area of the image display surface of the panel except for the openings of the unit light emitting areas, ambient light incident through the front glass substrate is absorbed by the absorption layer. This prevents reflection of the incident light and reduction in contrast on the screen due to the reflection.

The plasma display panel according to a ninth invention is characterized, in addition the configuration of the first invention, in that the unit light emitting areas are disposed to differ in alignment in the column direction from each other in each two adjacent unit light emitting area columns by half of length of the unit light emitting area in the column direction, and respectively formed therein with phosphor layers having three colors arranged in a sequence in the row direction, and a pixel is comprised of the three unit light emitting areas of the three respective colors arranged in a delta form along the two adjacent display lines.

According to the plasma display panel of the ninth invention, a pixel is made up of the three adjacent unit light emitting areas staggered from the neighboring unit light emitting area in the column direction and colored in the three primary colors.

The plasma display panel according to a tenth invention is characterized, in addition to the configuration of the fifth invention, by further including a dielectric layer formed on the backside of the front substrate to overlay the row electrodes, and in that an additional portion is formed on a portion of the dielectric layer facing the vertical wall portion of the partition wall above the electrode main body portion, to protrude toward the vertical wall portion to be in contact with the vertical wall portion.

According to the plasma display panel of the tenth invention, the additional portion formed on the dielectric layer, overlaying the row electrodes, to be in contact with the vertical wall of the partition wall prevents a false discharge from being generated between the adjacent unit light emitting areas.

The plasma display panel according to an eleventh invention is characterized, in addition to the configuration of the seventh invention, by further including a dielectric layer formed on the backside of the front substrate to overlay the row electrodes, in that an additional portion is formed on portions of the dielectric layer above the electrode main body portion, to protrude toward the partition wall portion to be in contact with the partition wall.

According to the plasma display panel of the eleventh invention, the additional portion is formed on the dielectric layer, overlaying the row electrodes, to be in contact with the partition wall. Such additional portion prevents a false discharge from being generated between the adjacent unit light emitting areas.

These and other objects and advantages of the present invention will become obvious to those skilled in the art upon review of the following description, the accompanying drawings and appended claims.

DETAILED DESCRIPTION OF THE PREFERRED EMBODIMENT

Most preferred embodiment according to the present invention will be described hereinafter in detail with reference to the accompanying drawings.

Figure 1:
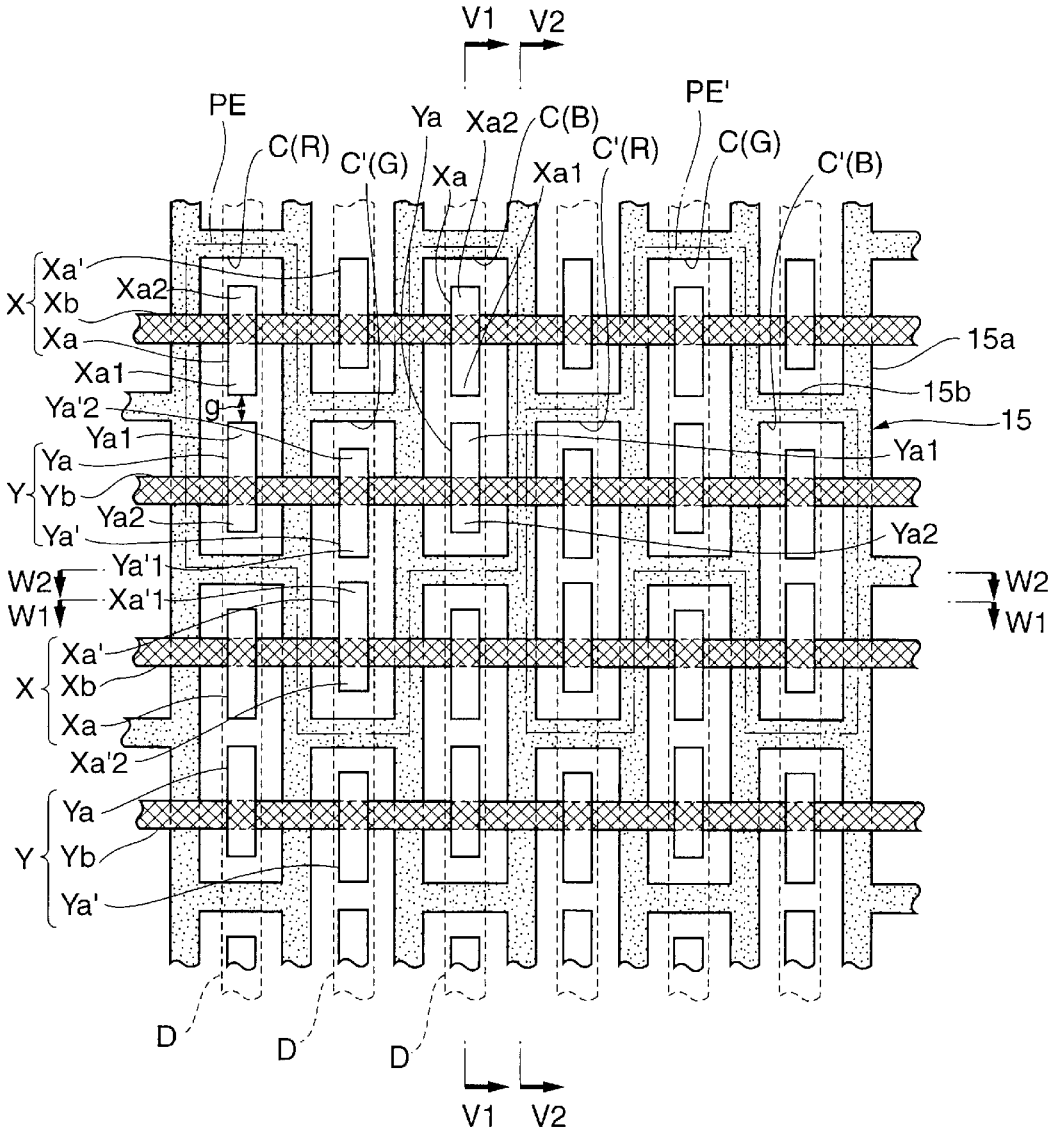
FIG. 1 is a schematically plane view showing an example of a plasma display panel according to the present invention.
Figure 2:
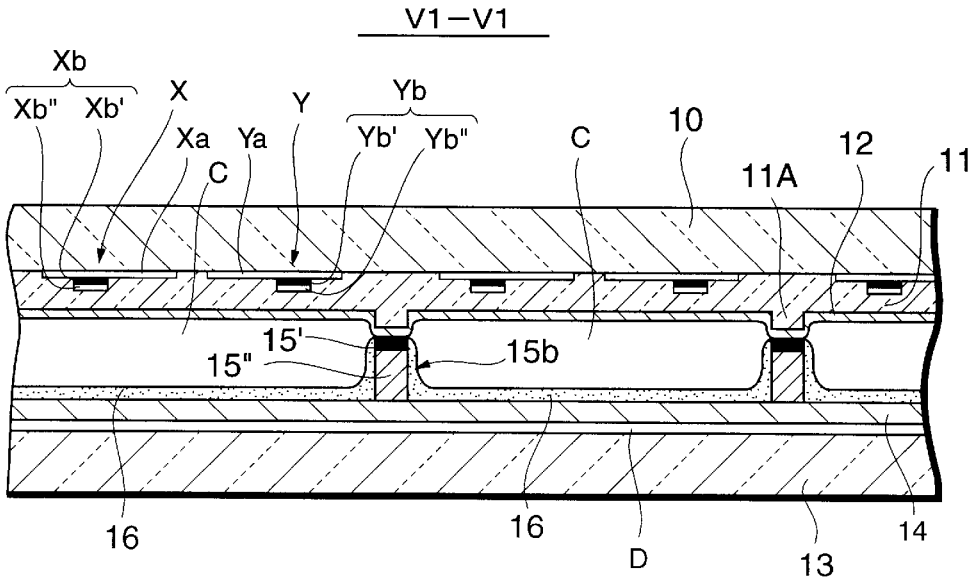
FIG. 2 is a sectional view taken along the V1—V1 line of FIG. 1.
Figure 3:
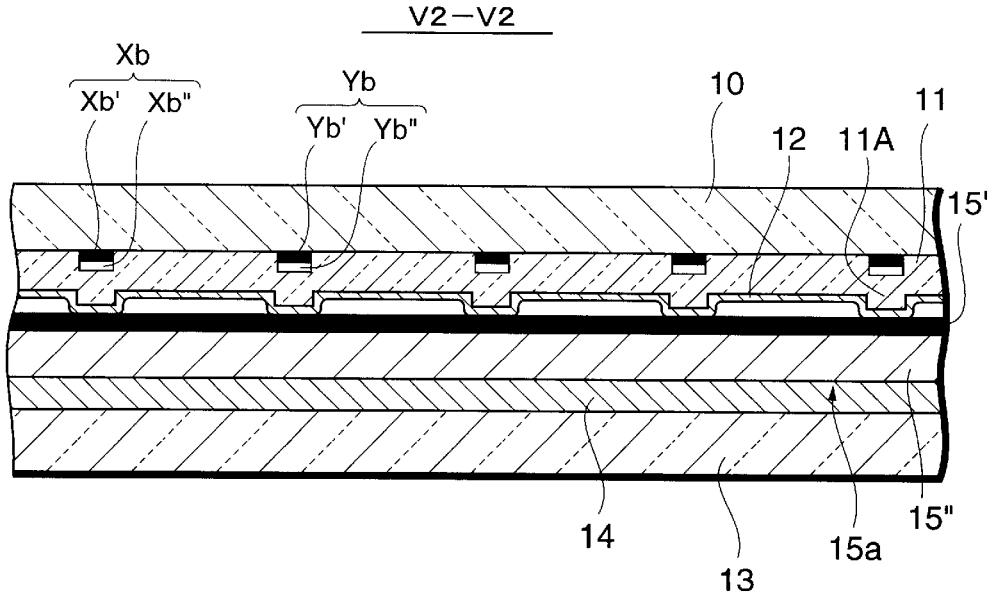
FIG. 3 is a sectional view taken along the V2—V2 line of FIG. 1.
Figure 4:
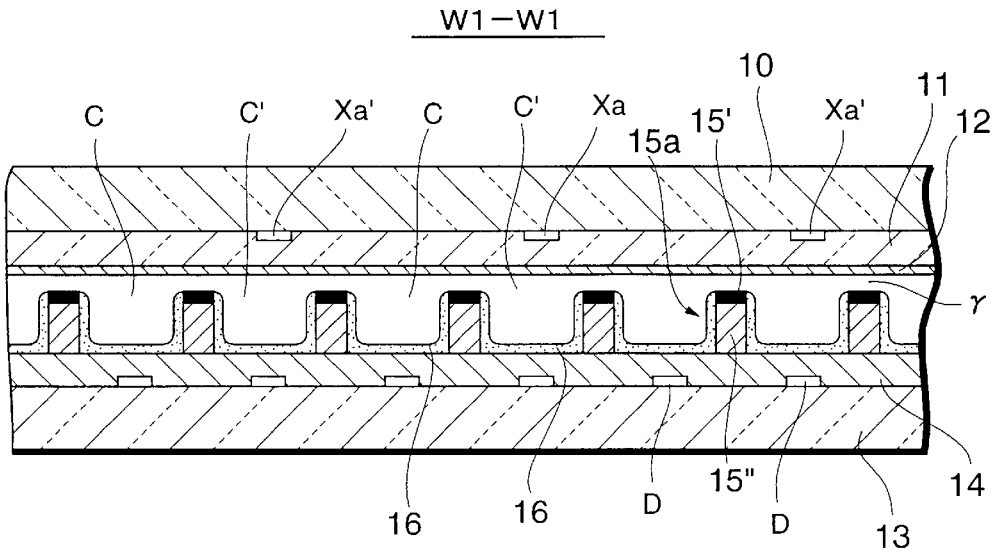
FIG. 4 is a sectional view taken along the W1—W1 line of FIG. 1.
Figure 5:
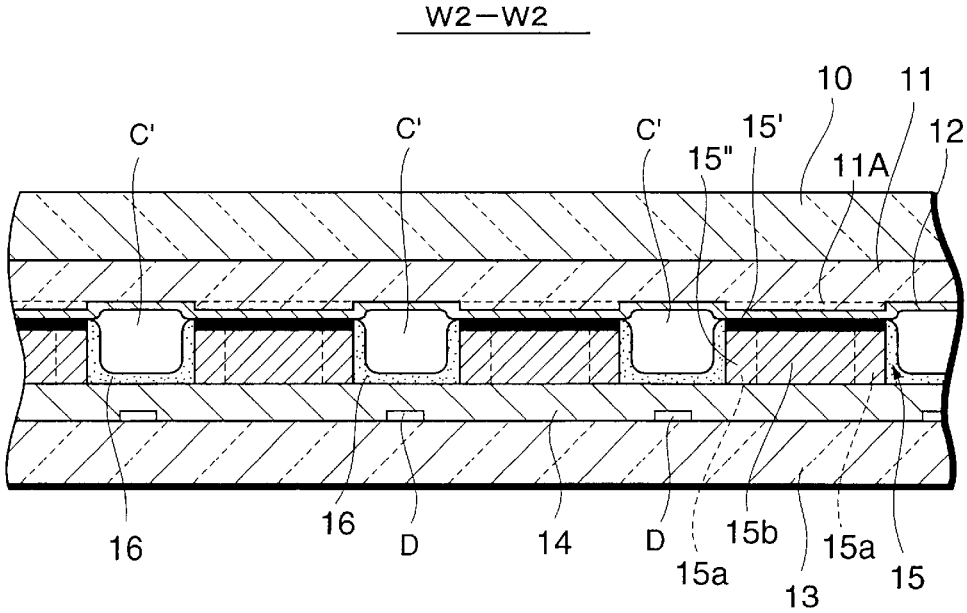
FIG. 5 is a sectional view taken along the W2—W2 line of FIG. 1.

FIGS. 1 to 5 illustrate a first example of the embodiment of a plasma display panel (referred as "PDP" hereinafter) according to the present invention. FIG. 1 is a plane view schematically presenting the relationship between a row electrode pair and a partition wall of the PDP. FIG. 2 is a sectional view taken along the V1—V1 line of FIG. 1. FIG. 3 is a sectional view taken along the V2—V2 line of FIG. 1. FIG. 4 is a sectional view taken along the W1—W1 line of FIG. 1. FIG. 5 is a sectional view taken along the W2—W2 line of FIG. 1.

In FIG. 1 to FIG. 5, on a backside of a front glass substrate 10 serving as the display surface, band-shaped bus electrodes Xb and Yb extending in the row direction (the traverse direction in FIG. 1) are alternated at regular intervals in the column direction (the vertical direction in FIG. 1) of the front glass substrate 10.

The bus electrode Xb is connected alternately to the transparent electrodes Xa and Xa' each formed of a transparent conductive film made of ITO or the like.

The transparent electrodes Xa and Xa' are alternated at regular intervals along the row direction, and each transparent electrode extends from both sides of the bus electrode Xb in the column direction to cross the bus electrode Xb at right angles. The transparent electrodes Xa and Xa' are connected to the bus electrode Xb to alternately protrude longer from one side of the bus electrode Xb than from the other side thereof in the opposite direction of each other.

Specifically, in FIG. 1, the transparent electrode Xa is connected to the bus electrode Xb such that a length of an extension Xa1 protruding downward from the side of the bus electrode Xb is approximately twice as long as the length of an extension Xa2 protruding upward therefrom. Conversely from transparent electrode Xa, the transparent electrode Xa' is connected to the bus electrode Xb such that a length of an extension Xa'1 protruding upward in FIG. 1 from the side of the bus electrode Xb is approximately twice as long as the length of an extension Xa'2 protruding downward therefrom.

The above transparent electrodes Xa and Xa' and bus electrode Xb make up the row electrode X.

Likewise, the bus electrode Yb is connected alternately to the transparent electrodes Ya and Ya' each formed of a transparent conductive film made of ITO or the like.

The transparent electrodes Ya and Ya' are alternated at regular intervals along the row direction, and respectively oppose the transparent electrodes Xa and Xa' in the column direction.

Each of the transparent electrodes Ya and Ya' extends from the both sides of the bus electrode Yb in the column direction to cross the bus electrode Yb at right angles. The transparent electrodes Ya and Ya' are connected to the bus electrode Yb to alternately extend longer from one side of the bus electrode Yb than from the other side thereof in the opposite direction of each other.

Specifically, in FIG. 1, the transparent electrode Ya is connected to the bus electrode Yb such that a length of an extension Ya1 protruding upward from the side of the bus electrode Yb is approximately twice as long as the length of an extension Ya2 protruding downward therefrom. Conversely from transparent electrode Ya, the transparent electrode Ya' is connected to the bus electrode Yb such that an extension Ya'1 protruding downward in FIG. 1 from the side of the bus electrode Yb is approximately twice as long as a length of an extension Ya'2 protruding upward therefrom.

The above transparent electrodes Ya and Ya' and bus electrode Yb make up the row electrode Y.

The spaced interval between the row electrodes X and Y is set such that leading ends of the respective extensions Xa1 and Ya1 of the transparent electrodes Xa and Ya are opposite to each other with a discharge gap g of a required width in between, and leading ends of the respective extensions Xa'1 and Ya'1 of the transparent electrodes Xa' and Ya' are opposite to each other with a discharge gap g of a required width in between.

Each of the bus electrodes Xb and Yb is formed in a double layer structure with a black conductive layer Xb' or Yb' located near the display surface and a main conductive layer Xb" or Yb" located near the back surface.

A dielectric layer 11 is further formed on the backside of the front glass substrate 10 to overlay the row electrode pairs (X, Y). Furthermore, on the backside of the dielectric layer 11, additional dielectric layers 11A are formed at positions opposing the midpoint position between the opposed leading ends of the respective extensions Xa2 and Ya2 of the transparent electrodes Xa and Ya, and the midpoint position between the opposed leading ends of the respective extensions Xa'2 and Ya'2 of the transparent electrodes Xa' and Ya'. The additional dielectric layer 11A having a required length, as described later, is formed to extend in parallel to the row direction and to protrude from the backside of the dielectric layer 11.

For forming the dielectric layer 11, a low-melting glass paste is processed to be a film shape having a predetermined thickness, and laminated and burned. The additional dielectric layer 11A is formed such that a low-melting glass paste is screen-printed at a predetermined thickness on the dielectric layer 11 and burned.

On the backsides of the dielectric layer 11 and the additional dielectric layers 11A, a protective layer 12 made of MgO is formed.

Conversely, a back glass substrate 13 is located in parallel to the front glass substrate 10. On the front surface of the back glass substrate 13 facing toward the display surface, column electrodes D are disposed at regularly established intervals from one another to extend in the column direction at positions opposing the transparent electrodes Xa and Ya and the transparent electrodes Xa' and Ya' for each pair of the row electrodes X and Y.

A white dielectric layer 14 is further formed on the front surface of the back glass substrate 13 to overlay the column electrodes D, and in turn formed thereon with a partition wall 15.

The partition wall 15 is composed of a vertical wall 15*a* extending in the column direction between the adjacent column electrodes D arranged in parallel to each other, and a transverse wall 15*b* extending in the row direction at a position opposing each additional dielectric layer 11A.

The partition wall 15 defines the discharge space between the front glass substrate 10 and the back glass substrate 13 to particular sections opposing the pair of transparent electrodes Xa and Ya and the pair of transparent electrodes Xa' and Ya' in the adjacent row electrodes X and Y, each pair having the discharge gap g in between. And thus quadrate discharge cells C and C' are formed.

As is clear from FIG. 1, therefore, the discharge cell C opposing the transparent electrodes Xa and Ya is located to stagger from the discharge cell C', opposing the transparent electrodes Xa' and Ya', in the column direction for a half of a longitudinal width of each cell.

The partition wall 15 is formed in a two-layer structure with a black layer (a light absorption layer) 15' on the display surface side and a white layer 15" on the back surface side, which is configured such that the side walls facing the discharge cells C and C' are almost white (i.e. a light reflection layer).

In the partition wall 15, a face on the display surface side of the transverse wall 15*b* is in contact with a portion of the protective layer 12 which overlays the additional dielectric layer 11A (see FIGS. 2, 3 and 5), so as to shield the adjacent discharge cells C from each other and the adjacent discharge cells C' from each other in the column direction. A face on the display surface side of the vertical wall 15*a* is not in contact with the protective layer 12 (see FIG. 4) to form a space r between the vertical wall 15*a* and the protective layer 12.

On five faces of a surface of the dielectric layer 14 and side faces of the vertical walls 15*a* and the transverse walls 15*b* of the partition wall 15 facing each discharge cell C, C', a phosphor layer 16 is formed to overlay all of them.

The phosphor layers 16 are set in order of red, green and blue for the sequence of discharge cells in the row direction and the same color is arranged in the column direction.

As illustrated in FIG. 1, a pixel PE is constituted of three discharge cells adjoined in the row direction: a discharge cell C(R) formed with a red phosphor layer 16, a discharge cell C'(G) formed with a green phosphor layer 16 and a discharge cell C(B) formed with a blue phosphor layer 16. A pixel PE' is constituted of three discharge cells next to the pixel PE: a discharge cell C'(R) formed with a red phosphor layer 16, a discharge cell C(G) formed with a green phosphor layer 16: and a discharge cell C'(B) formed with a blue phosphor layer 16.

Each of the discharge cells C and C' is hermetically filled with a discharge gas.

Operation of displaying an image on the PDP is carried out as in the case of the conventional PDP.

Specifically, first, through address operation, the opposite discharge is produced selectively between the row electrode pairs (X, Y) and the column electrodes D in the respective discharge cells C and C', to scatter lighted cells (the discharge cell formed with wall charge on the dielectric layer 11) and nonlighted cells (the discharge cell not formed with wall charge on the dielectric layer 11), over the panel in accordance with the image to be displayed.

After the address operation, the discharge sustain pulses are applied alternately to the row electrodes X and Y, and thus the surface discharge is produced in each lighted cell on every application of the discharge sustain pulse.

In this manner, the surface discharge in each lighted cell generates ultraviolet light, and thus the red, green and blue phosphor layers 16 each formed in the discharge cell are individually excited to emit light, resulting in forming the display screen.

In the above PDP, each of the transparent electrodes Xa and Xa' is disposed to protrude from both sides of the bus electrode Xb of the row electrode X along the column direction. Each of the transparent electrodes Ya and Ya' is also disposed to protrude from the both sides of the bus electrode Yb of the row electrode Y in the column direction. Hence, it is possible to increase each length of the transparent electrodes Xa, Xa', Ya and Ya' in the column direction, as compared with a conventional configuration in which a transparent electrode of one of a row electrode pair is protruded from a bus electrode toward a transparent electrode of the other.

For this reason, the discharge cells C and C' formed in each section facing the pair of transparent electrodes Xa and Ya and each section facing the pair of transparent electrodes Xa' and Ya' are increased in opening area per cell on the display surface side. This increases a surface area of the phosphor layer 16 formed in each of the discharge cells C, C', resulting in increasing the amount of light emission at the time of the surface discharge.

Increasing each length of the transparent electrodes Xa, Xa', Ya and Ya' in the column direction increases efficiency of light emission to prevent reduction in luminance associated with high definition of images.

In the aforementioned PDP, the black layers Xb', Yb' and 15' all of which absorb light overlay the faces on the display surface side of the bus electrodes Xb and Yb and partition wall 15 occupying the area of the image display surface of the panel except for the openings of discharge cells C and C'. Hence, even if the number of partition walls 5 or row electrodes X and Y is increased with the increase of the number of pixels due to high definition of images, ambient light incident upon the bus electrodes or partition wall is not reflected but is absorbed by the black layers Xb', Yb' and 15', resulting in preventing the contrast of screen from being decreased by the reflected light.

Moreover, the aforementioned PDP is formed with the additional dielectric layer 11A on the dielectric layer 11. The protective layer 12 overlaying the additional dielectric layers 11A is in contact with the faces on the display surface side of the transverse walls 15*b* of the partition wall 15, to shield the adjacent discharge cells C from each other and the adjacent discharge cells C' from each other in the column direction (see FIG. 2). This prevents occurrence of interference between discharges of the adjacent discharge cells C, C' in the column direction.

It should be mentioned that in the aforementioned PDP, the faces on the display surface side of the vertical walls 15*a* of the partition wall 15 exclusive of part thereof oppose to the portions of the dielectric layer 11 which are not formed with the additional dielectric layer 11A, and the space r is formed between the faces of the vertical walls 15*a* on the display surface side and the protective layer 12 (see FIGS. 3 and 4). For this reason, the adjacent discharge cells C and C' in the row direction are slightly coupled through the space r to trigger the priming effect for generating linking discharges, resulting in stabilization of the discharge operation.

In addition, the aforementioned PDP is configured such that each of the transparent electrodes Xa, Ya, Xa' and Ya' is independently shaped into an island-like form in each discharge cell C, C'. Therefore, even if each discharge cell is reduced in size to increase definition of a screen, it is possible to prevent occurrence of interference between discharges of the adjacent discharge cells in the row direction.

Figure 6:
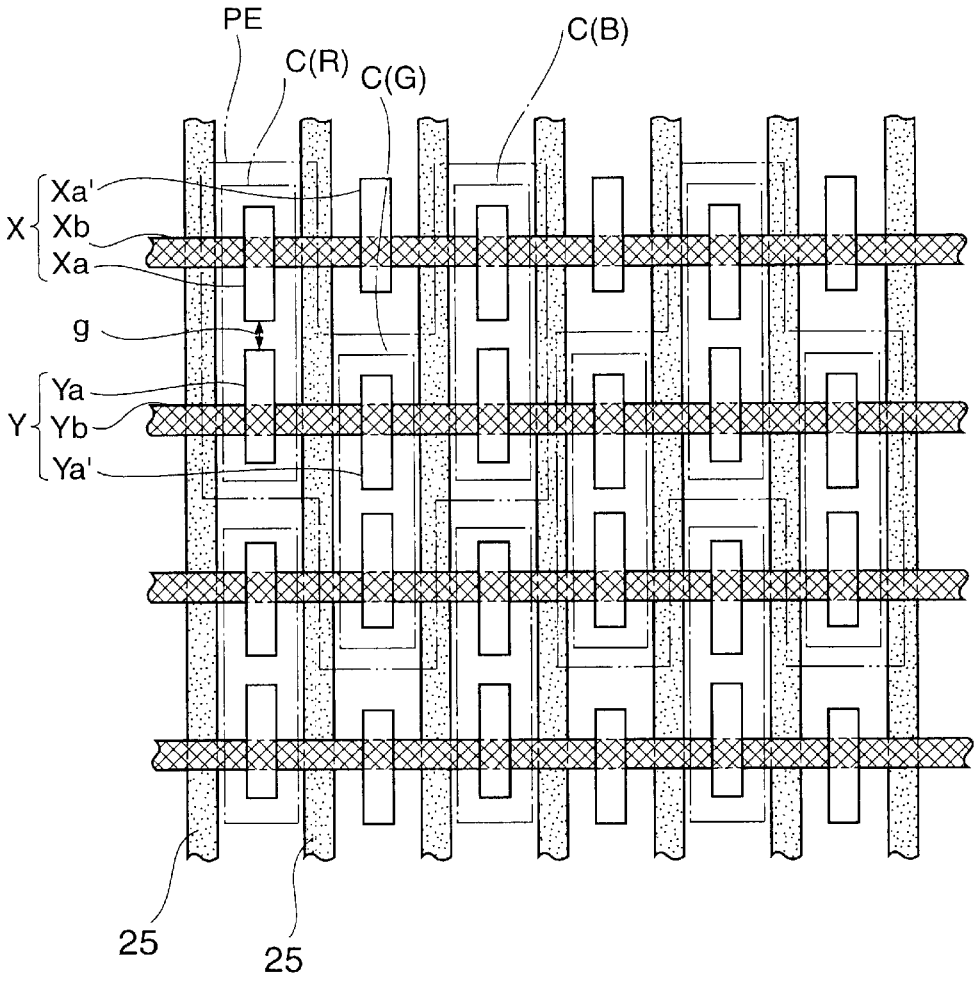
FIG. 6 is a schematically plane view showing another example of a plasma display panel according to the present invention.

FIG. 6 is a schematic plane view showing another example in the embodiment of the present invention.

In the PDP of the first example of FIGS. 1 to 5, the partition wall defining the discharge cells is composed of the vertical walls extending in the column direction and the transverse walls extending in the row direction. In a PDP of the example, each of discharge cells C and C' is defined by a band-shaped partition wall 25 extending in the column direction and not having a transverse wall.

The configuration of the remaining components is the same as that of the aforementioned PDP of the example of FIGS. 1 to 5, and the same reference numerals are used for those components.

Through the same operation as the PDP of the example shown in FIGS. 1 to 5, light is emitted in each discharge cell C, C' to form an image.

The example of FIGS. 1 to 5 has illustrated the configuration in which the additional dielectric layers are provided at portions of the dielectric layer facing the vertical wall of the partition wall above the electrode main body (bus electrode) and the transverse wall of the partition wall. In the example of FIG. 6, the additional dielectric layer may be formed at portions of a dielectric layer facing the partition wall above an electrode main body to protrude toward the partition wall to be in contact with the partition wall.

Figure 7:
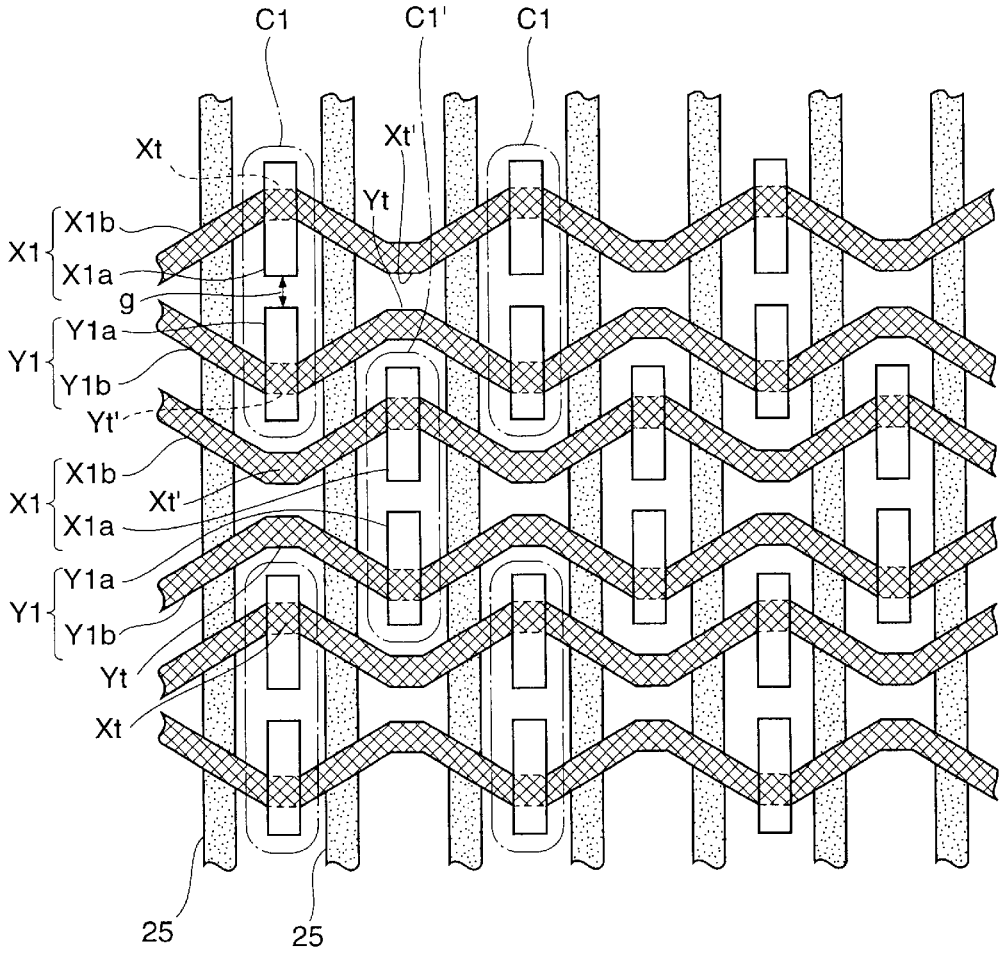
FIG. 7 is a schematically plane view showing still another example of a plasma display panel according to the present invention.
Figure 8:
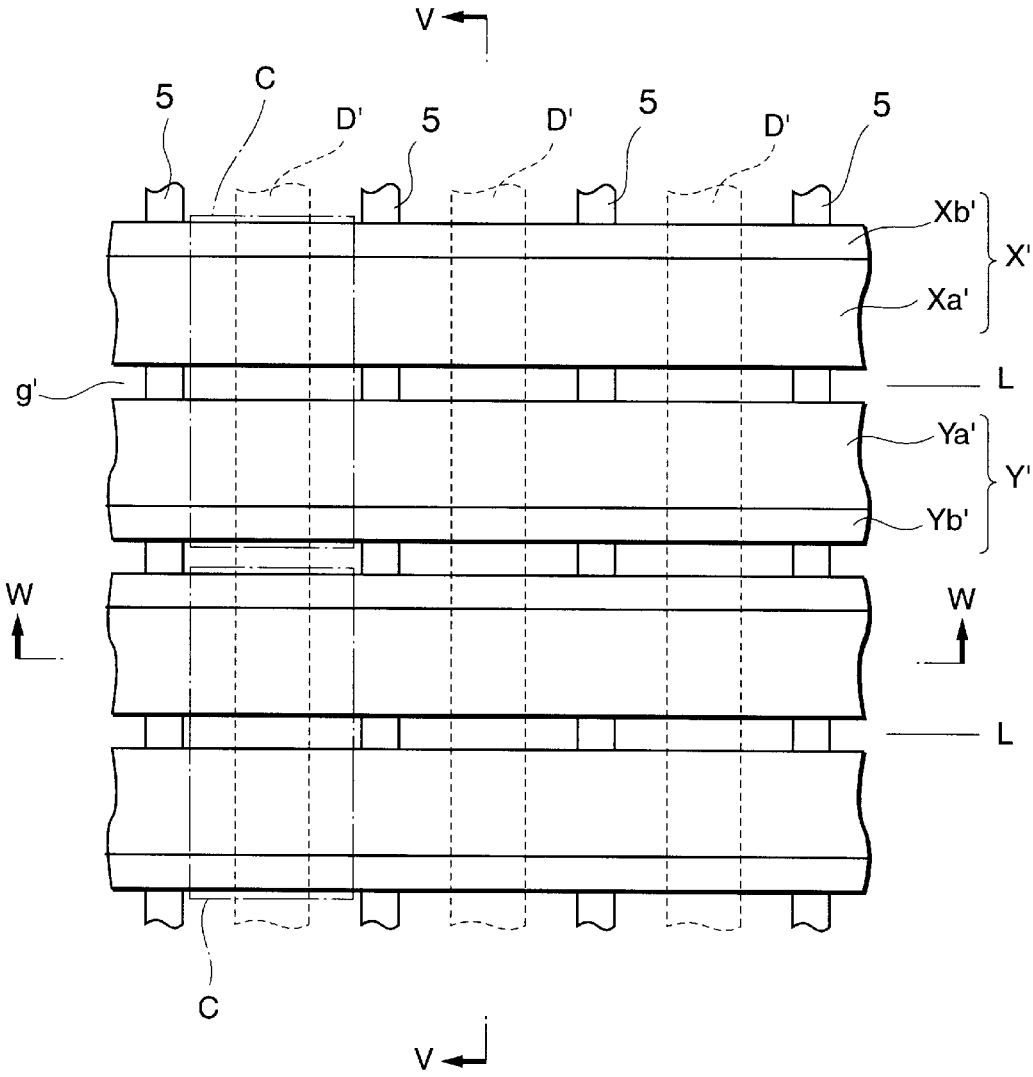
FIG.8 PRIOR ART
FIG. 8 is a schematically plane view showing a conventional plasma display panel.
Figure 9:
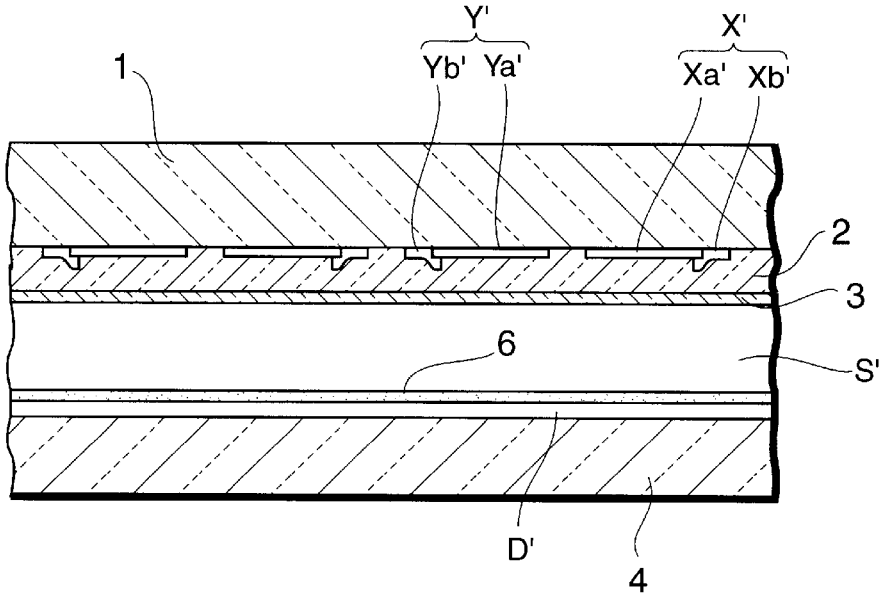
FIG.9 PRIOR ART
FIG. 9 is a sectional view taken along the V—V line of FIG. 8.
Figure 10:
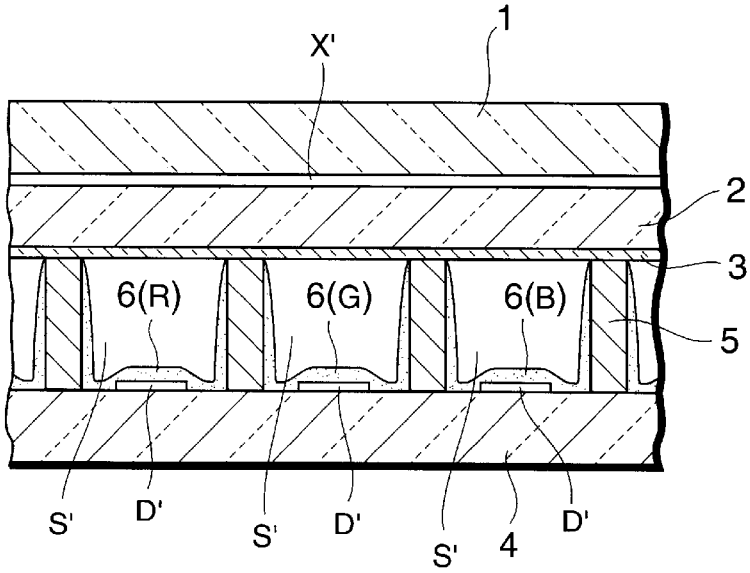
FIG.10 PRIOR ART
FIG. 10 is a sectional view taken along the W—W line of FIG. 8.

FIG. 7 is a schematic plane view of still another example in the embodiment of the present invention.

In a PDP of the example, as in the case of the PDP of the example of FIG. 6, each of discharge cells C1 and C1' is defined by the band-shaped partition wall 25 extending in the column direction and not having a transverse wall.

Bus electrodes X1b and Y1b of respective row electrodes X1 and Y1 are extended in the row direction and corrugated such that the direction of intersecting with the partition wall 25 alternates between upward and downward directions. Each top of the corrugated bus electrode protruding in the column direction (referred to upward tops as Xt, Yt and downward tops as Xt', Yt' in FIG. 7) is designed to be situated at the correct midpoint position between the adjacent partition walls 25.

The row electrodes X1 and Y1 are alternated in the column direction and the adjacent row electrodes X1 and Y1 are paired with each other. The bus electrodes X1*b* and Y1*b* of the row electrode pair X1 and Y1 are separated from each other at a required interval, and are arranged such that in one column between the adjacent partition walls 25, upward protruding tops Xt and Yt of bus electrodes X1*b* and Y1*b* of a pair of row electrodes X1 and Y1 are alternated with downward protruding tops Xt' and Yt' of bus electrodes X1*b* and Y1*b* of the next pair of row electrodes X1 and Y1.

The bus electrodes X1*b* and Y1*b* of the pair of row electrodes X1 and Y1 are respectively connected to transparent electrodes X1*a* and Y1*a* at the tops Xt and Yt' positioned at which the opposing bus electrodes X1*b* and Y1*b* of the pair of adjacent row electrodes are more widely separated.

Each transparent electrode X1*a*, Y1*a* extends from both sides of each bus electrode X1*b*, Y1*b* in the column direction, one extension extending from one side of the bus electrode toward a neighboring row electrode pair being shorter than the other extension extending from the other side toward the mate of the row electrode pair.

In each pair of adjacent row electrodes X1 and Y1, the transparent electrodes X1*a* and Y1*a* extend from the respective bus electrodes X1*b* and Y1*b* toward each other to allow their leading ends to oppose each other with a gap g in between.

Each leading end of the transparent electrodes X1*a* and Y1*a* extending toward the mate of the row electrode pair is situated at the midpoint position between the row electrode pair X1 and Y1.

Each of the discharge cells C1 and C1' are formed at a section facing a pair of transparent electrodes X1*a* and Y1*a* opposing each other in the column direction between the pair of adjacent row electrodes (X1, Y1). The discharge cells C1 and C1' are alternated in the row direction and situated in a staggered arrangement.

The configuration of the remaining parts is the same as that of the PDP of the aforementioned example of FIGS. 1 to 5. Therefore, light is emitted in particular discharge cells C and C' through a similar operation to that of the PDP of the Example of FIGS. 1 to 5, to form an image.

The example of FIGS. 1 to 5 has illustrated the configuration in which the additional dielectric layers are provided at portions of the dielectric layer facing the vertical wall of the partition wall above the electrode main body (bus electrode) and the transverse wall of the partition wall. In the example of FIG. 7, the additional dielectric layer may be formed at portions of a dielectric layer facing the partition wail above an electrode main body to protrude toward the partition wall to be in contact with the partition wall.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel comprising a plurality of row electrodes extending in the row direction on a backside of a front substrate and arranged in the column direction, a dielectric layer overlaying the row electrodes on a backside of a front substrate, and a plurality of column electrodes extending in the column direction on a surface of a back substrate facing the front substrate with a discharge space in between and arranged in the row direction, wherein said row electrode has electrode main body portions extending in the row direction and a plurality of protrusion electrode portions extending in the column direction and arranged along said electrode main body portions to intersect and connect with said electrode main body portions, wherein said protrusion electrode portions of said row electrode are alternately paired with said protrusion electrodes of said two row electrodes on both sides of the row electrode, an end of said protrusion electrode portion of said row electrode opposes to an end of said paired protrusion electrode portion of the row electrode adjacent thereto, with a required gap in between, and a unit light emitting area is formed in each of said discharge spaces between said back substrate and a section of said protrusion electrode portions paired by said two opposing ends of said protrusion electrode portions, wherein said unit light emitting areas are defined by a partition wall which is disposed between said front substrate and said back substrate, said partition wall is made up by a vertical wall portion which extends in the column direction and a transverse wall portion which extends in the row direction and is arranged to shift by a half length of said unit light emitting area in the column direction every other transverse wall portion, and wherein an additional portion is formed on a portion of said dielectric layer facing said transverse wall portion of said partition wall, to protrude toward said transverse wall portion to shield said adjacent unit light emitting areas from each other in the column direction.

2. The plasma display panel according to claim 1, wherein said protrusion electrode portion of said row electrode extends longer from one side of said electrode main body portion than from the other side thereof, and ends of the longer extensions of said respective protrusion electrode portions of said adjacent row electrodes make a pair, opposing each other with said required gap.

3. The plasma display panel according to claim 1, further comprising a light absorption layer not reflecting light formed on the front face of said electrode main body portion of said row electrode.

4. The plasma display panel according to claim 1, wherein a light absorption layer not reflecting light is formed on the face on the front substrate side of said partition wall.

5. The plasma display panel according to claim 1, wherein said unit light emitting areas are disposed to differ in alignment in the column direction from each other in each two adjacent unit light emitting area columns by half of length of said unit light emitting area in the column direction, and respectively formed therein with phosphor layers having three colors arranged in a sequence in the row direction, and a pixel is comprised of said three unit light emitting areas of the three respective colors arranged in a delta form along the two adjacent display lines.

6. The plasma display panel according to claim 1, further comprising a dielectric layer formed on the backside of said front substrate to overlay said row electrodes, wherein an additional portion is formed on a portion of said dielectric layer facing said vertical wall portion of said partition wall above said electrode main body portion, to protrude toward said vertical wall portion to be in contact with the vertical wall portion.

7. A plasma display panel comprising a plurality of row electrode pairs extending in the row direction on a backside of a front substrate and arranged in the column direction, and a plurality of column electrodes extending in the column direction on a surface of a back substrate facing the front substrate with a discharge space in between and arranged in the row direction, wherein each row electrode which constitutes said row electrode pair has electrode main body portions extending in the row direction and a plurality of protrusion electrode portion extending in the column direction and arranged along said electrode main body portion to connect with said electrode main body portions, wherein an end of said protrusion electrode portion of said row electrode opposes to an end of said protrusion electrode portion of the paired row electrode, with a required gap in between, and a unit light emitting area is formed in each of said discharge spaces between said back substrate and a section of said protrusion electrode portions paired by said two opposing ends of said protrusion electrode portions, and wherein said paired electrode main body portions of said row electrode pair are regularly corrugated such that an interval between said paired electrode main body portions is alternately spread and narrowed along the row direction, and each protrusion electrode portion is connected with said electrode main body portion at a position which said interval between said paired electrode main body portions is spread.

8. The plasma display panel according to claim 7, wherein said unit light emitting areas are defined by a band-shaped partition wall extending in the column direction between said front substrate and said back substrate.

9. The plasma display panel according to claim 8, wherein a light absorption layer not reflecting light is formed on the face on the front substrate side of said partition wall.

* * * * *